US006071550A

United States Patent [19]

Ueberschär et al.

[11] Patent Number: 6,071,550

[45] Date of Patent: Jun. 6, 2000

[54] METHOD OF MAINTAINING AN ANGLE BETWEEN A DOCTOR BLADE AND AN OPPOSING SURFACE AT A PREDETERMINED VALUE

[75] Inventors: Manfred Ueberschär, Nattheim; Thomas Klein, Giengen; Franz Fischer, Heidenheim, all of Germany

[73] Assignee: Voith Sulzer Papiermaschinen GmbH, Heidenheim, Germany

[21] Appl. No.: 09/118,243

[22] Filed: Jul. 17, 1998

[30] Foreign Application Priority Data

Jul. 24, 1997 [DE] Germany ..... 197 31 947

[51] Int. Cl.[7] ..... B05D 3/12

[52] U.S. Cl. ..... 427/8; 427/356; 118/123; 118/126; 118/413

[58] Field of Search ..... 118/126, 123, 118/413; 427/8, 356

[56] References Cited

U.S. PATENT DOCUMENTS

| | | | |
|---|---|---|---|
| 4,169,425 | 10/1979 | Wohrle | 118/665 |
| 4,309,960 | 1/1982 | Waldvogel | 118/665 |
| 4,780,336 | 10/1988 | Damrau | 427/356 |

FOREIGN PATENT DOCUMENTS 30 36 274 C2 9/1980 Germany .

*Primary Examiner*—Katherine A. Bareford
*Attorney, Agent, or Firm*—Taylor & Aust, P.C.

[57] ABSTRACT

A device for the application of a liquid or viscous medium onto a running opposing surface includes a doctor blade that is mounted on a support beam, whereby the relative positions of the support beam and the opposing surface are adjustable by use of a regulating device. A flexible pressure tubing that is adjustable against the doctor blade is also provided on the support beam. In the process of controlling/regulating the device, the operating condition of the coating applicator is recorded, control values are established on the basis of the recorded results, and the regulating device and/or fluid pressure in the flexible pressure tubing is influenced on the basis of the established control values. Control/adjustments are made in such a manner that the angle of attack between the doctor blade and the opposing surface is maintained at a predetermined value. The tension condition of the flexible pressure tubing is recorded as an operating condition value and information regarding the deformation characteristics of the flexible pressure tubing, as well as the bending characteristics of the doctor blade, are considered when establishing the control values.

9 Claims, 3 Drawing Sheets

METHOD OF MAINTAINING AN ANGLE BETWEEN A DOCTOR BLADE AND AN OPPOSING SURFACE AT A PREDETERMINED VALUE

BACKGROUND OF THE INVENTION

1. Field of the Invention

The present invention relates to a method of controlling or regulating a device that is intended for the application of a liquid or viscous medium onto an opposing surface. The opposing surface may, for example, be the surface of a running material web, particularly paper or cardboard, or the application surface of an operating applicator unit, especially an applicator roll from which the liquid or viscous medium is transferred to such a material web.

2. Description of the Related Art

A generic method is known, for example, from German Patent Document No. DE 30 36 274 C2. This process is performed on an applicator device in which the doctor blade is pressed, by use of a flexible pressure tubing, against the running opposing surface. The doctor blade is mounted on a support beam whose position relative to the opposing surface is adjustable. At the start of an applicator unit's operating cycle, the doctor blade is adjusted by an operator to a predetermined contact pressure against the opposing surface. The adjustment angle of the doctor blade can be selected such that a doctoring surface at the free end of the doctor blade is substantially parallel to the opposing surface. Should the coating application result achieved with this arrangement require a correction in the contact pressure of the doctor blade against the opposing surface, then the "new" doctor blade contact pressure will be adjusted on the basis of a measurement taken from the coating application result. The adjustment is made by changing the position of the support beam relative to the opposing surface and/or by changing the fluid pressure in the flexible pressure tubing. However, the coating application result achieved with the aforementioned known process does not provide fully satisfactory results at high operating speeds.

SUMMARY OF THE INVENTION

The present invention provides a method of achieving improved coating application results, particularly at high running speeds of the opposing surface. The angle of attack between the doctor blade and the opposing surface is maintained at a predetermined value, while the tension condition of the flexible pressure tubing is regarded as an operating condition parameter to be considered when establishing control values. Information regarding the deformation characteristics of the flexible pressure tubing as well as the bending characteristics of the doctor blade are also considered.

The applicants have found that irregularities in the coating application results, particularly at high operating speeds, stem from the doctoring surface of the doctor blade being very slightly non-parallel to the opposing surface. Such non-parallelism had previously been considered tolerable. However, it has become evident that the increased dynamic flow pressures of liquid or viscous mediums against the doctor blade that are associated with the high operating speeds of modern machinery for the production of paper and cardboard lead to irregularities of the coating application. When the doctor blade is angled too steeply in relation to the opposing surface, as indicated in FIG. 3*b*, so-called "doctor streaks" occur. When the doctor blade is angled too flat, as shown in FIG. 3*c*, excessive passage of the coating medium through the application nip between the doctor blade and the opposing surface occurs.

Avoidance of the previously described problems by maintaining the parallel position of the doctoring surface of the doctor blade relative to the opposing surface raises additional problems, however. There is no technology available with which the position of the doctoring angle relative to the opposing surface can be measured during operation of the coating unit. According to the invention, this problem is avoided by using an indirect method to measure the angle of attack of the doctor blade relative to the opposing surface and thereby determine the relative positions of the doctoring surface and the opposing surface. The tension of the flexible pressure tubing is captured as a measured value. The bending line of the doctor blade is determined on the basis of information on the deformational characteristics of the flexible pressure tubing, as well as the bending characteristics of the doctor blade. The angle of attack for the doctor blade can be determined on the basis of this knowledge. With the process according to the invention, it is therefore possible to ensure a satisfactory coating application result at high operating speeds.

The deformational characteristics of the flexible pressure tubing and the bending characteristics or the doctor blade may enter in different ways into the process according to the invention. For example, this information may be taken into consideration in the form of analytical models. On the basis of these models, the angle of attack for the doctor blade is calculated from the measured tension of the flexible pressure tubing. The model describing the bending characteristics may include, for example, details on height and thickness of the blade, type and dimensions of fastening devices on the support beam, and similar information. It is also possible for this information regarding the deformational characteristics of the flexible pressure tubing and the bending characteristics of the doctor blade to be in the form of tables, stored in data memory or data fields, which contain an appropriate angle of attack for each tension. The content of these data fields is determined during a series of tests prior to the actual coating operation.

A measurable operating parameter that is representative of the tension of the flexible pressure tubing could be, for example, the fluid pressure in the flexible pressure tubing. This fluid pressure is normally maintained at a constant value using a feedback loop, resulting in a change in the contact pressure of the flexible pressure tubing against the doctor blade through either enlargement or reduction of the contact surface of the flexible pressure tubing on the doctor blade. However, a change in the doctor blade's position relative to the flexible pressure tubing always initially results in a small pressure increase or pressure reduction which can be measured and referred to in establishing the tension in the flexible pressure tubing.

In addition, or alternatively, the aforementioned deformation of the flexible pressure tubing may be measured directly, for example by use of wire strain gauges or such. The measured deformation may be used as an operating parameter, representative of the tension of the flexible pressure tubing.

If information regarding the relative positions of support beams and opposing surfaces are considered when establishing control values, then this would permit further increase in flexibility and precision of the process according to the invention. This is because a change in the relative positions of the support beam and the opposing surface also affects the position of the doctor blade against the opposing surface.

Beyond that, the result can be recorded and the resulting data considered when establishing the control values. This possibility permits fully automatic operation of the coating applicator.

If wear and tear of the doctor blade is recorded and the resulting data is also considered when establishing the control values, then an increase in control or regulating accuracy is possible, since wear and tear of the doctor blade and the associated height reduction affects its bending characteristics. A very simple possibility of considering the wear and tear of the doctor blade may be, for example, to record the operational life of the doctor blade and to determine the actual wear and tear of the doctor blade on the basis of experimental values of wear and tear.

With the process according to the invention, a doctor blade for leveling out the liquid or viscous medium is mounted upon a support beam whose position is adjustable relative to the opposing surface by use of a regulating device. A flexible pressure tube that is activated by fluid pressure, and which is adjustable against the doctor blade, is provided on the support beam. The value of at least one parameter that is representative of the operational condition of the coating applicator unit is recorded. Control values for the regulating device and/or the fluid pressure in the flexible pressure tubing is established on the basis of at least one recorded operational condition parameter. The regulating device and/or the fluid pressure in the flexible pressure tubing is influenced based upon the established control values.

The equalizing unit that includes the support beam and doctor blade may be run in various modes of operation which, depending on operational conditions of the coating applicator and characteristics of the opposing surface and the fluid or viscous medium, may be advantageous. Under the first mode of operation, the fluid pressure in the flexible pressure tubing and/or the regulating device are controlled or regulated such that the doctor blade, when viewed in a section taken in the cross direction of the coating applicator, follows a gradient in accordance with which the contact point of the flexible pressure tubing on the doctor blade is on the inlet side of a reference line. The reference line corresponds to a profile of a doctor blade that is not loaded and that is mounted on a support beam. That is, the doctor blade is neither supplied by the flexible pressure tubing nor adjusted against the opposing surface. The free end of the doctor blade is substantially on the reference line. It is furthermore possible to control or regulate the fluid pressure inside the flexible pressure tubing and/or the regulating device to bend the doctor blade such that the contact point of the flexible pressure tubing on the doctor blade is substantially on the reference line and the free end of the doctor blade is on the outlet side of the reference line. Finally, the fluid pressure inside the flexible pressure tube and/or the regulating device may be controlled or regulated to bend the doctor blade such that neither the contact point of the flexible pressure tubing on the doctor blade nor the free end of the doctor blade will be on the reference line. For example, the point of contact of the flexible pressure tubing on the doctor blade could be on the infeed side of the reference line and the free end of the doctor blade could be on the outlet side of the reference line.

At the start of the control or regulating phase for the angle of attack, that is, prior to the actual start-up of the coating applicator, a basic adjustment is made to the regulating device and/or the fluid pressure inside the flexible pressure tubing. This basic adjustment may be carried out manually by an operator. It is, however, also possible to make these basic adjustments semi-automatically or fully automatically by utilizing the possibilities of the process according to the invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
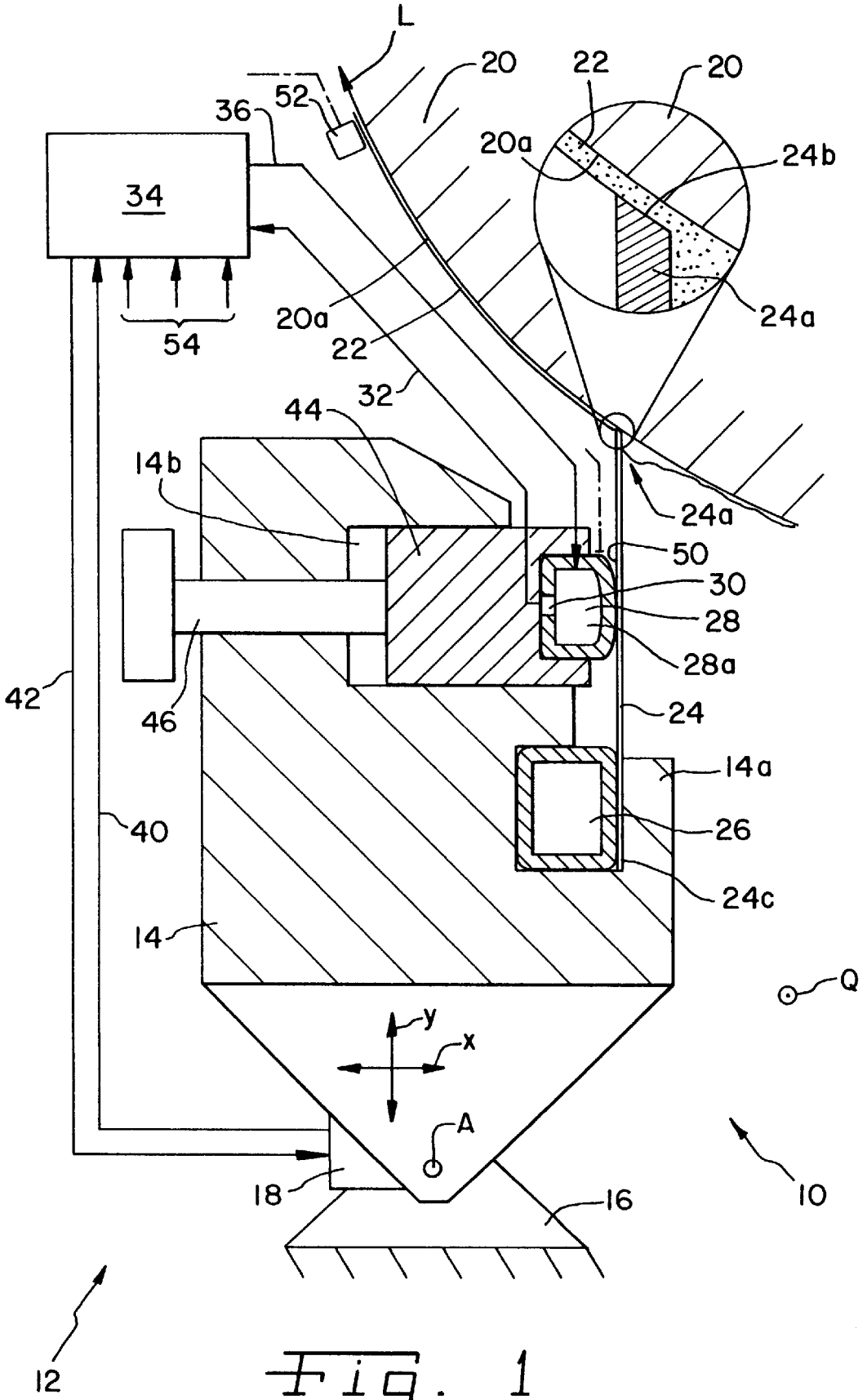
FIG. 1 is a schematic, side view of a leveling unit of a coating applicator which may be operated in accordance with one embodiment of the method of the present invention.

Referring now to the drawings and particularly to FIG. 1, there is shown a schematic, side view of one embodiment of the leveling unit 12 of a coating applicator, generally identified as 10. The leveling unit 12 includes a support beam 14 which is mounted on a frame 16 of the coating applicator 10 and which is adjustable at A. An actuating drive 18 is provided to assist in adjustments of the support beam 14 relative to the frame 16 in order to influence therewith a relative position with regard to an opposing surface 20*a*. For reasons of clarity, the adjustability of the support beam 14 is shown in FIG. 1 only as a possible pivoting of the support beam 14 about axis A. However, it is understood that in addition to the pivot drive 18, actuating drives can also be provided for the transpositional transfer of the support beam 14 in the plane of the two directions X and Y.

In the illustrated structural example, the opposing surface 20*a* is the surface of an applicator roll 20 from which the coating medium 22 will be transferred to a not-illustrated material web, in particular paper or cardboard. The opposing surface 20*a* could, however, also be represented by the surface of such a material web onto which the liquid or viscous medium 22 is directly applied.

A doctor blade 24 is mounted on support beam 14 and is clamped by a flexible pressure tubing 26 to a mounting section 14*a* of the support beam 14. The pressure fluid supply lines for the flexible pressure tubing 26 are not shown in FIG. 1 for the sake of clarity. The free end 24*a* of the doctor blade 24 is adjusted to the opposing surface 20*a* in such a manner that a doctoring surface 24*b* of the doctor blade 24 is substantially parallel to the opposing surface 20*a*, as illustrated in FIG. 1 in the top right-hand corner in the enlarged detailed area.

To provide contact pressure for the doctor blade 24 against the opposing surface 20*a*, a flexible pressure tubing 28 is provided on the support beam 14. Pressure tubing 28 engages the doctor blade 24 between its mounting end 24*c* and its free end 24*a*. The pressure in the cavity 28*a* of the flexible pressure tubing 28 is measured with a pressure sensor 30 and is transmitted via a line 32 to a control unit or regulating device 34. Control unit 34 triggers a pressure regulating valve in such a manner that the pressure in the cavity 28*a* is kept substantially constant through a pressure fluid supply line 36.

If, for example, the hydrodynamic pressure of the coating medium 22 rises on the infeed side of the doctor blade 24, that is, on the right-hand side of blade 24 in FIG. 1, free end 24*a* of doctor blade 24 drifts to the left in machine direction L. The force exerted by doctor blade 24 causes such deformation of the flexible pressure tubing 28 that its contact surface on the doctor blade 24 increases. As a result of the increased contact surface, the contact pressure of the flexible pressure tubing 28 on the doctor blade 24 also increases, with the level of internal pressure within the flexible pressure tubing 28 remaining constant. Thus, the drifting of the doctor blade 24 due to flow pressure is limited. Through a small increase in the internal pressure in the flexible pressure tubing 28, the drifting of the doctor blade 24 that is associated with flow pressure can be compensated for.

Figures 2A, 2B, 2C:
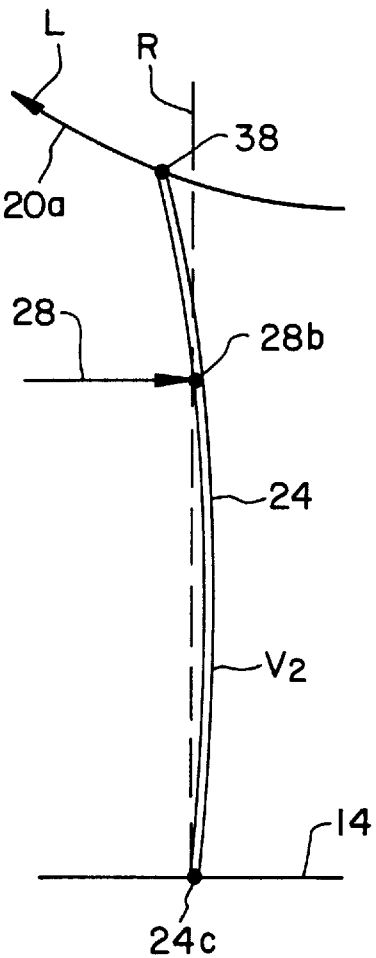
FIG. 2*a* is a rough, schematic illustration of one mode of operation of the leveling unit of FIG. 1.
FIG. 2*b* is a rough, schematic illustration of another mode of operation of the leveling unit of FIG. 1.
FIG. 2*c* is a rough, schematic illustration of yet another mode of operation of the leveling unit of FIG. 1.

In the simplified illustration of FIG. 1, doctor blade 24 is shown as being substantially straight. This, of course, is not consistent with the actual conditions. On the contrary, the doctor blade 24 does curve or bend under the influences of its mounting on the support beam 14 at end 24*c*, the flexible pressure tubing 28, and the hydrodynamic flow pressure in the area of the opposing surface 20*a*. Several such curves are illustrated in FIGS. 2*a* through 2*c*. Because of the influence of an increased hydrodynamic flow pressure on the free end 24*a* of the doctor blade 24, as well as an increased contact pressure of the flexible pressure tubing 28 on the doctor blade 24, doctor blade 24 follows a more strongly curved gradient than in FIG. 1, wherein the flow pressure is lower. To maintain the desired application distance between the doctoring surface 24*b* of the doctor blade 24 and the opposing surface 20*a*, the fluid pressure in the flexible pressure tubing 28 must again be slightly increased.

Figure 3A:
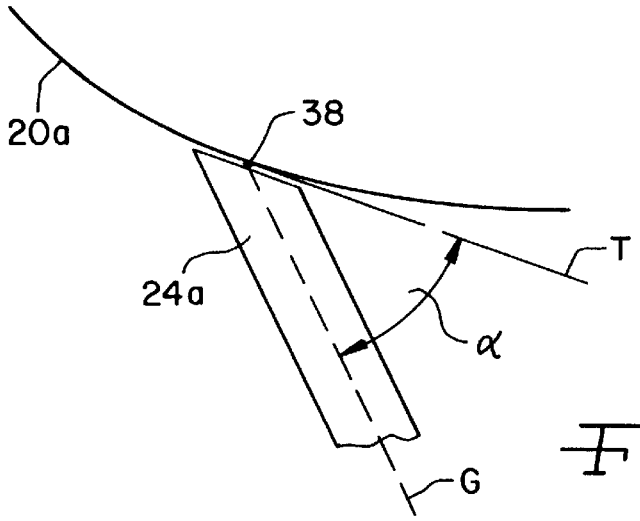
FIG. 3*a* is a schematic illustration of one adjustment position of the doctor blade of the leveling unit of FIG. 1 relative to the opposing surface.
Figure 3B:
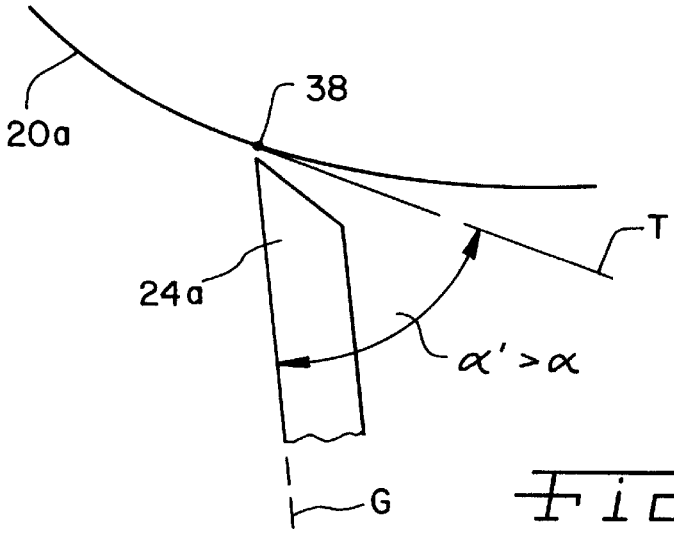
FIG. 3*b* is a schematic illustration of another adjustment position of the doctor blade of the leveling unit of FIG. 1 relative to the opposing surface.
Figure 3C:
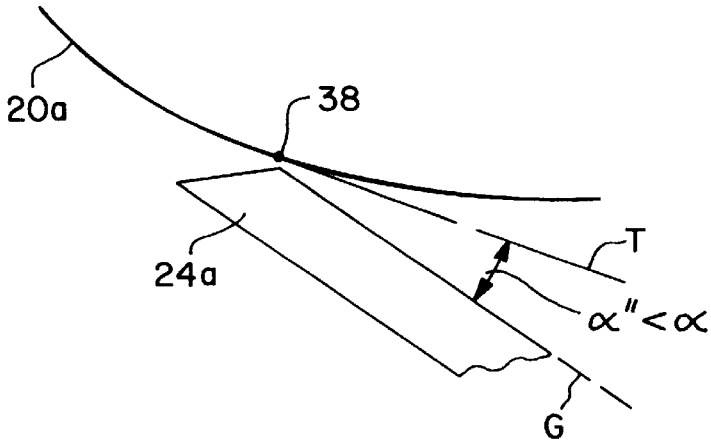
FIG. 3*c* is a schematic illustration of yet another adjustment position of the doctor blade of the leveling unit of FIG. 1 relative to the opposing surface.

As a result of a change in the degree of bending of the doctor blade 24, the angle of attack $\alpha$ (FIG. 3*a*) of the doctor blade 24 against the opposing surface 20*a* also changes. Angle of attack $\alpha$ is the angle between a tangent T to the opposing surface 20*a* at an adjustment point 38 of the doctor blade 24 and a straight line G that approximates the orientation of the free end 24*a* of doctor blade 24. As already previously discussed, in order to achieve satisfactory application results, it is important that the doctoring surface 24*b* of the doctor blade 24 is always substantially parallel to the opposing surface 20*a* during the application process. Thus, the desired angle of attack $\alpha$ between free end 24*a* of the doctor blade 24 and the opposing surface 20*a* is always within tight tolerances during operation. In particular, situations involving angles of attack $\alpha$ that are too obtuse (see FIG. 3*b*; $\alpha'>\alpha$) or too acute (see FIG. 3*c*; $\alpha''<\alpha$) should be avoided.

In the event that the doctoring surface 24*b* and the opposing surface 20*a* become intolerably non-parallel, perhaps due to an increase in the interior pressure in the flexible pressure tubing 28, then a correction can be made by adjusting the orientation of support beam 14 relative to the opposing surface 20*a* in order to reestablish strict parallelism between doctoring surface 24*b* and opposing surface 20*a*. For this purpose, information regarding the current position of the support beam 14 is provided to the control unit 34 via a data line 40. In order to effect the above-mentioned correction, control unit 34 provides actuating signals via a data line 42 to the control mechanism 18.

It is also possible to influence the cross profile of the layer of coating medium 22 that has been applied to the opposing surface 20*a*, that is, the coating application profile running in a cross direction Q of apparatus 10 that is orthogonal to the running direction of the machine. For this purpose, the flexible pressure tubing 28 extends in a flexible bar 44 which is mounted and slides in a recess in the support beam 14. A multitude of actuators 46 are provided in cross direction Q. In the embodiment of FIG. 1, actuators 46 are shown as manually adjusted screws, however, they may also take the form of remotely controlled actuators. With the assistance of screws 46, the flexible pressure tubing 28 can be positioned against the doctor blade 24 incrementally in cross direction Q at various levels of pressure.

In addition to, or as an alternative to, the interior pressure of the flexible pressure tubing 28, the tension condition of the flexible pressure tubing 28 may be determined by the pressure sensor 30 based upon the level of deformation. For this, wire strain gauges 50 may, for example, be provided whose recording signals are transmitted to the control unit 34 via a signal line as indicated by a dot-dash line in FIG. 1.

Measuring results may also be considered in establishing the control values which provide information regarding the achieved coating application results. For example, a coating application sensor 52 may be provided. The sensor signals of this and other sensors that sense the operating condition of the coating applicator 10 are supplied to the control or regulating unit 34 through additional control inputs 54. These sensor signals may be considered in establishing the control values for the fluid pressure in the flexible pressure tubing 28 and the regulating device 18.

FIGS. 2*a*, 2*b* and 2*c* are rough, schematic illustrations of three different bending lines of doctor blade 24. These bending lines are consistent with typical modes of operation of the leveling unit 12. All three figures show a broken reference line R which represents the profile of a doctor blade 24 that is mounted at 24*c* on the support beam 14 and that is loaded by neither the flow pressure of the application medium 22 nor the flexible pressure tubing 28. Furthermore, the load of the doctor blade 24 by the flexible pressure tubing 28 is always shown as a rough, schematic illustration, indicated by an arrow, whereby the contact point of the flexible pressure tubing 28 on the doctor blade 24 is identified as 28*b*. In all three illustrations, the mounting point 24*c* of doctor blade 24 onto support beam 14 is, of course, on the reference line R.

According to the operational mode of leveling unit 12 illustrated in FIG. 2*a*, the doctor blade 24 follows a curved gradient $V_1$ according to which the contact point 28*b* of the flexible pressure tubing 28 on the doctor blade 24 is arranged on the inlet side of the reference line R, while the doctor blade 24 is substantially positioned against the opposing surface 20*a* on the reference line R. According to FIG. 2*b*, the doctor blade 24 is curved (gradient $V_2$) in such a manner that the contact point 28*b* of the flexible pressure tubing 28 on the doctor blade 24 is substantially on the reference line R, while its contact point 38 is arranged on the outlet side of reference line R. Consistent with a third operational mode which could be regarded as a combination of the operational modes illustrated in FIG. 2*a* and FIG. 2*b*, the doctor blade in FIG. 2*c* is curved ($V_3$) such that neither the contact point 28*b* of the flexible pressure tubing 28, nor the contact point 38 of doctor blade 24 on the opposing surface 20*a* is arranged on the reference line R. More precisely, in the illustrated structural example in FIG. 2*c*, the contact point 28*b* of flexible pressure tubing 28 is arranged on the inlet side of the reference line R, while the doctor blade 24 is positioned at 38 against the opposing surface 20*a* on the outlet side of reference line R.

Regardless of which mode of operation is considered the most favorable for a particular application process, it can always be reliably ensured that the application distance of the doctoring surface 24*b* from the opposing surface 20*a* is at the desired value, and that the doctoring surface 24*b* runs substantially parallel to the opposing surface 20*a*. This is achieved by influencing the adjustment condition of the flexible pressure tubing 28 against the doctor blade 24 as well as by possibly influencing the relative positions of support beam 14 and opposing surface 20*a*. This influencing is performed by taking into account the data fields which are stored in control unit 34 and which represent the deformation characteristics of flexible pressure tubing 28 and the bending characteristics of the doctor blade 24.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of one of controlling and regulating an apparatus for the application of a coating medium onto an opposing surface, the opposing surface being one of a surface of a traveling fiber material web and an application surface of a coating applicator said method comprising the steps of:

providing a support beam:

mounting a doctor blade on said support beam said doctor blade being configured for leveling out the coating medium after the coating medium has been applied to the opposing surface, said doctor blade having a position relative to the opposing surface, providing a regulating device configured for adjusting said position of said doctor blade;

providing a substantially flexible pressure tubing on said support beam, said pressure tubing being adjustable by fluid pressure against said doctor blade;

recording a value of a deformation of said pressure tubing caused by applying pressure, said deformation being representative of a tension condition of said pressure tubing;

establishing a plurality of control values for at least one of said regulating device and said fluid pressure in said pressure tubing, said establishing step being dependent upon said recorded deformation, information regarding deformation characteristics of said pressure tubing and information regarding bending characteristics of said doctor blade;

adiusting at least one of said regulating device and said fluid pressure in said flexible pressure tubing to thereby change said position of said doctor blade, said adjusting step being dependent upon said established control values; and maintaining an angle of attack between said doctor blade and the opposing surface at a predetermined value as a result of said adjusting step thereby leveling out the coating medium on the opposing surface.

2. The method of claim 1, wherein said establishing step is further dependent upon information regarding relative positions of said support beam and the opposing, surface.

3. The method of claim 1, wherein said establishing step includes the substep of recording an application result including resulting data, said establishliing step also being dependent upon said resulting data.

4. The method of claim 1, comprising the further steps of:

providing a reference line representing said doctor blade when said doctor blade is in an unloaded state, said reference line extending substantially linearly between said pressure tubing and the opposing surface; and one of controlling and regulatinig at least one of said fluid pressure in said pressure tubing and said regulating device such that said doctor blade, when viewed in a cross direction of the apparatus, follows a gradient wherein a contact point of said pressure tubing on said doctor blade is on an inlet side of said reference line, and wherein a free end of said doctor blade is substanitially on said reference line.

5. The method of claim 1, comprising the further step of making an adjustment to at least one of said regulating device and said fluid pressure inside said pressure tubing, said making step occurring at a start of one of a control phase and a regulating phase for said angle of attack, said making step being performed one of by an operator and automatically.

6. A method of one of controlling and regulating an apparatus for the application of a coating medium onto an opposing surface, the opposing surface being one of a surface of a traveling fiber material web and an application surface of a coating applicator, said method comprising the steps of:

providing a support beam;

mounting a doctor blade on said support beam, said doctor blade being configured for leveling out the coating medium after the coating medium has been applied to the opposing surface, said doctor blade having a position relative to the opposing surface;

providing, a regulating device configured for adjusting said position of said doctor blade;

providing a substanitially flexible pressure tubing on said support beam, said pressure tubing being adjustable by fluid pressure against said doctor blade;

recording a value of a tension condition of said pressure tubing;

establishing a plurality of control values for at least one of said regulating device and said fluid pressure in said pressure tubing, said establishing step including the substep of recording data representing, wear and tear of said doctor blade, said establishing step also being dependent upon said wear and tear data, said tension value, information regarding deformation characteristics of said pressure tubing and information regarding bending characteristics of said doctor blade;

adjusting at least one of said regulating device and said fluid pressure in said flexible pressure tubing to thereby change said position of said doctor blade, said adjusting step being dependent upon said established control values; and maintaining an angle of attack between said doctor blade and the opposing surface at a predetermined value as a result of said adjusting step, thereby leveling out the coating medium on the opposing surface.

7. A method of one of controlling and regulating an apparatus for the application of a coating medium onto an opposing surface, the opposing surface being one of a surface of a traveling fiber material web and an application surface of a coating applicator, said method comprising the steps of:

providing a support beam;

mounting a doctor blade on said support beam, said doctor blade being configured for leveling out the coating medium after the coating medium has been applied to the opposing surface, said doctor blade leaving a position relative to the opposing surface;

providing a regulating device configured for adjusting said position of said doctor blade;

providing a substanitially flexible pressure tubing on said support beam, said pressure tubing being adjustable by fluid pressure against said doctor blade;

recording a value of a tension condition of said pressure tubing;

establishing a plurality of control values for at least one of said regulating device and said fluid pressure in said pressure tubing, said establishing step being dependent upon said tension value, information regarding deformation characteristics of said pressure tubing and information regarding bending characteristics of said doctor blade;

adjusting at least one of said regulating device and said fluid pressure in said flexible pressure tubing to thereby change said position of said doctor blade, said adjusting step being dependent upon said established control values;

maintaining an angle of attack between said doctor blade and the opposing surface at a predetermined value as a result of said adjusting step, thereby leveling out the coating medium on the opposing surface;

providing a reference line representing said doctor blade when said doctor blade is in an unloaded state, said reference line extending substantially linearly between said pressure tubing and the opposing surface; and one of controllinig and regulating at least one of said fluid pressure in said pressure tubing and said regulating device such that said doctor blade, when viewed in a cross direction of the apparatus, follows a gradient wherein a contact point of said pressure tubing on said doctor blade is substantially on said reference line, and wherein a free end of said doctor blade is on an outlet side of said reference line.

8. A method of one of controlling and regulating an apparatus for the application of a coating medium onto an opposing surface, the opposing surface being one of a surface of a traveling fiber material web and an application surface of a coating applicator, said method comprising the steps of:

providing a support beam;

mounting a doctor blade on said support beam, said doctor blade being configured for leveling out the coating medium after the coating medium has been applied to the opposing surface, said doctor blade having a position relative to the opposing surface;

providing a regulating device configured for adjusting said position of said doctor blade;

providing a substantially flexible pressure tubing, on said support beam said pressure tubing being adjustable by fluid pressure against said doctor blade;

recording a value of a tension condition of said pressure tubing;

establishing a plurality of control values for at least one of said regulating device and said fluid pressure in said pressure tubing, said establishing step being dependent upon said tension value, information regarding deformation characteristics of said pressure tubing and information regarding bending characteristics of said doctor blade;

adjusting at least one of said regulating device and said fluid pressure in said flexible pressure tubing to thereby change said position of said doctor blade, said adjusting step being dependent upon said established control values;

maintaining an angle of attack between said doctor blade and the opposing surface at a predetermined value as a result of said adjusting step, thereby leveling out the coating medium on the opposing surface;

providing a reference line representing said doctor blade when said doctor blade is in an unloaded state, said reference line extending substantially linearly between said pressure tubing and the opposing surface; and one of controlling and regulating at least one of said fluid pressure in said pressure tubing and said regulating device such that said doctor blade when viewed in a cross direction of the apparatus, follows a gradient wherein a contact point of said pressure tubing on said doctor blade is on one of an inlet side and an outlet side of said reference line, and wherein a free end of said doctor blade is on another of said inlet side and said outlet side of said reference line.

9. The method of claim 8, wherein said step of one of controlling and regulatinig is performed such that said doctor blade, when viewed in the cross direction of the apparatus, follows a gradient wherein said contact point of said pressure tubing on said doctor blade is on said inlet side of said reference line, and wherein said free end of said doctor blade is on said outlet side of said reference line.

* * * * *

UNITED STATES PATENT AND TRADEMARK OFFICE

CERTIFICATE OF CORRECTION

PATENT NO. : 6,071,550

DATED : June 6, 2000

INVENTOR(S) : Manfred Ueberschar, et al.

It is certified that error appears in the above-identified patent and that said Letters Patent is hereby corrected as shown below:

COLUMN 9

Line 22, delete "leaving" and substitute --having-- therefor.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*